US007497178B2

(12) United States Patent
Park

(10) Patent No.: US 7,497,178 B2
(45) Date of Patent: Mar. 3, 2009

(54) APPARATUS FOR DRIVING EMBROIDERY FRAME OF EMBROIDERY MACHINE

(75) Inventor: Hoo Sik Park, Incheon (KR)

(73) Assignee: Sunstar Precision Co., Ltd., Incheon, ROK ( * ) Notice: Subject to any disclaimer, the term of this patent is extended or adjusted under 35 U.S.C. 154(b) by 0 days.

(21) Appl. No.: 11/753,594

(22) Filed: May 25, 2007

(65) Prior Publication Data

US 2008/0168935 A1 Jul. 17, 2008

(30) Foreign Application Priority Data

Jan. 17, 2007 (KR) ..... 10-2007-0005457
Mar. 8, 2007 (KR) ..... 10-2007-0023140

(51) Int. Cl.
*D05B 21/00* (2006.01)
*D05B 27/00* (2006.01)

(52) U.S. Cl. ..... 112/470.18

(58) Field of Classification Search ..... 112/470.14, 112/470.18, 103, 311; 38/102.91, 102.2
See application file for complete search history.

(56) References Cited

U.S. PATENT DOCUMENTS 3,750,186 A * 7/1973 Sakamoto ..... 346/33 MC
4,365,564 A * 12/1982 Sugiyama ..... 112/470.06
4,386,573 A * 6/1983 Davidson et al. ..... 112/103
4,406,234 A * 9/1983 Johnson et al. ..... 112/470.18
4,602,578 A * 7/1986 Yokoe et al. ..... 112/470.18
4,665,844 A * 5/1987 Shibata ..... 112/103
5,127,348 A * 7/1992 Scholl et al. ..... 112/470.18
5,553,565 A * 9/1996 Ono et al. ..... 112/470.18
6,405,667 B2 * 6/2002 Fenzel ..... 112/470.18

* cited by examiner

*Primary Examiner*—Ismael Izaguirre
(74) *Attorney, Agent, or Firm*—Harness, Dickey & Pierce, PLC

(57) ABSTRACT

Disclosed is a driving apparatus of an embroidery frame of a sewing machine in which a driving unit of a sewing frame reciprocates on an X- and/or Y-axis fixed frames, installed to a beam-body of the sewing machine so that a uniform driving force can be transmitted to the embroidery frame, inferior embroidery caused by vibration can be prevented, a size of the sewing machine is reduced, and a high-speed operation is enabled. The apparatus includes an embroidery frame driving unit having the embroidery frame to fix an object and placed on a table of the sewing machine, and a Y-directional movement mechanism to move the frame driving unit in the Y-direction. The Y-directional movement mechanism includes a fixed frame having gear teeth, and an embroidery frame driving unit installed on the fixed frame engaged with the gear teeth to reciprocate the frame driving unit in the Y-direction.

12 Claims, 10 Drawing Sheets

APPARATUS FOR DRIVING EMBROIDERY FRAME OF EMBROIDERY MACHINE

FIELD

The present invention relates to an apparatus for driving an embroidery frame of a sewing machine, and more particularly, to a driving apparatus of an embroidery frame of a sewing machine in which a driving unit of a sewing frame (embroidery frame) reciprocates on an X-axis fixed frame and/or a Y-axis fixed frame which is installed to a beam-body of the sewing machine so that an uniform driving force can be transmitted to overall the embroidery frame, inferior embroidery caused by vibration of the embroidery frame during the transfer can be prevented, a size of a table of the sewing machine is reduced, and a high-speed operation is enabled.

DESCRIPTION OF THE PRIOR ART

As generally known in the art, there are an embroidery machine and a sewing machine as sewing machines. The embroidery machine represents a machine in which a sewing needle bar moves up and down and an embroidery frame, to which a workpiece fabric is fixed, travels in the X-axis direction and the Y-axis direction to embroider as a user wishes. The sewing machine is usually used in home.

There is a difference between the sewing machine and the embroidery machine in view that the sewing machine moves the workpiece fabric by a saw tooth-shaped mover and sews the workpiece fabric and the embroidery machine transfers the embroidery frame to hold the workpiece fabric in the X-axis direction and the Y-axis direction to embroider the workpiece fabric.

In the embroidery machine, since the embroidery frame to hold the workpiece fabric moves in the X-axis direction and the Y-axis direction to embroider the workpiece fabric, the precise movement and a constant speed of the embroidery frame are closely connected to the quality of the embroidery.

Accordingly, a servo motor or an induction motor capable of controlling speed is used as a driving unit to move the needle bar of the embroidery machine up and down, a stepping motor which has an excellent positioning function and is easy to control is usually used as a driving unit to move the embroidery machine in the X-axis direction and the Y-axis direction.

There are several types of the embroidery machine such as a single head type automatic embroidery machine having a single head, a multi-head type automatic embroidery machine having two or more heads, and a special embroidery machine such as a computer quilting machine.

Hereinafter, configuration and operation of the conventional embroidery machine will be described with reference to the accompanying drawings.

FIG. 1 is an external appearance of a conventional multi-head type automatic embroidery machine, and FIG. 2 is a view illustrating a head and a shuttle driving unit of the embroidery machine in FIG. 1.

The multi-head type automatic embroidery machine, as illustrated in FIGS. 1 and 2, includes a beam-body 1 to support the embroidery machine, a table 2 installed on the beam-body 1, an embroidery frame (or an embroidery table) 3 installed on the table 2 to fix cloth to be embroidered, a plurality of heads 4 installed on an upper shaft 11 upper than the embroidery frame 3 to perform the embroidery, a shuttle (or a hook) 15 installed on a lower shaft 12 lower than the table 2 to face the heads 4 and to feed a lower thread, a main controller box 5 installed at the lower side of the table 2, and a manipulation panel 6 installed at a side of the table 2. A main shaft driving motor 13 is installed at a lower side of the table 2. A first belt 14*a* connects a rotation shaft of the main shaft driving motor 13 and the lower shaft 12, and the lower shaft 12 and the upper shaft 11 is connected to each other by a second belt 14*b*.

Thus, due to the rotation of the main shaft driving motor 13, the lower shaft 12 and the upper shaft 11 rotate. Due to the rotation of the lower shaft 12, the shuttle 15 is driven to feed the lower thread for the embroidery. Due to the rotation of the upper shaft 11, the needle bar 4*a* installed in the head 4 is driven to embroider the cloth.

In order to increase the productivity, the embroidery machine usually includes a plurality of head 4 (for example, 10 to 24 heads). The plural heads 4 are connected to each other by a signal rotation shaft (upper shaft), each of the heads 4 has a plurality of needles (for example, 6 to 15 needles), and different colored various threads are connected to the respective needles. Thus, the heads 4 embroider the cloth using various colored threads according to a desired embroidery pattern.

Meanwhile, there are proposed various type movement mechanisms to control and move the embroidery frame positioned on the horizontal sewing table in the X-direction and in the Y-direction (right-to-left and front-to-rear directions) on a planar coordinate based on various embroidery data stored in a computer.

FIG. 3 is a plan view illustrating a driving apparatus of an embroidery frame of the conventional automatic embroidery machine having two embroidery heads.

The conventional driving apparatus of an embroidery frame of a sewing machine, as illustrated in FIG. 3, includes a table 6 to which an object to be embroidered is placed, an embroidery frame 26 installed at the upper side of the table 6 to fix the object to be embroidered, and an elongated frame driving unit 10 to hold the embroidery frame 26. In this case, the embroidery frame 26 includes a pair of elongated horizontal frames and a pair of a vertical frames, installed at the upper side of the table 6, to support the object to be embroidered, and has a rectangular shape. In the lower side of the table 6, a movement mechanism 59 is installed to move the embroidery frame 26 on the sewing table 6 in the front-to-rear direction (Y-direction) and in the right-to-left direction (X-direction).

In the lower side of the sewing table 6, a Y-directional movement mechanism 11 is installed to move the embroidery frame 26 in the Y-direction. The Y-directional movement mechanism 11 includes pulleys 67 and 68 supported to rotate at the front side and the rear side thereof, two elongated belts 69 and 70 extended between the pulleys 67 and 68, and a Y-directional driving motor 14 connected to the right and left pulleys 68, positioned at the rear side, by a connecting shaft 13.

The two right and left belts 68 and 70 and the frame driving unit 10 are connected to each other by slits 12 formed in the Y-direction of the sewing table 6.

Thus, the forward and backward rotation of the Y-directional driving motor 14 is controller such that the frame driving unit 10 and the embroidery frame 26 held by the frame driving unit 10 are moved in the Y-direction.

Moreover, in the lower sides of the respective sewing heads 5, cylindrical supports 7 are installed to correspond to the heads 5.

In the frame driving unit 10, an X-directional movement mechanism 21 is installed to move the embroidery frame 26 in the X-direction. The X-directional movement mechanism 21 includes pulleys 71 and 72 rotatably supported by the right and left ends thereof, an elongated belt 73 extended between the pulleys 71 and 72, and an X-directional driving motor directly connected to the right pulley 72.

Connecting bodies 75 are connected to the belt 73 by a predetermined distance, the embroidery frame 26 is horizontally attached to the connecting bodies 75 to protrude toward the front side of the frame driving unit 10.

Thus, the X-directional driving motor 74 rotates forward and backward so that the embroidery frame 26 reciprocates in the X-direction.

However, in the conventional driving apparatus of an embroidery frame of a sewing machine, since the embroidery frame is moved by the elongated timing belt, slip occurs or the timing belt is loosened during the power transmission of the timing belt so that the driving force is not precisely transmitted.

Moreover, when the movement range of the embroidery frame is increased, the length of the timing belt is also increased in the Y-direction. If the length of the timing belt is elongated in the Y-direction, vibration may be easily generated as much as the increased length, there is generated a backlash so that it is difficult to transmit the driving force and there is a limit for a high-speed operation.

Furthermore, due to the Y-directional driving motor positioned at the rear side of the Y-directional movement mechanism, the overall width of the sewing machine is increased.

SUMMARY

Accordingly, the present invention has been made to solve the above-mentioned problems occurring in the prior art, and it is an aspect of the present invention to provide a driving apparatus of an embroidery frame of a sewing machine in which an embroidery frame driving unit reciprocates on an X-axis fixed frame and/or a Y-axis fixed frame which is installed in a beam-body of the sewing machine so that a uniform movement driving force can be transmitted to overall the embroidery frame, the embroidery can be precisely performed according to embroidery data at a high-speed to obtain high-quality embroidered patterns, and the Y-directional width of the sewing machine is decreased to reduce overall width of the sewing machine.

It is another aspect of the present invention to provide a driving apparatus of an embroidery frame of a sewing machine having a rack and pinion type power transmission including gear teeth formed in a fixed frame installed in a beam-body of the sewing machine and a timing belt provided in an embroidery frame driving unit and having gear teeth engaged with the gear teeth of the fixed frame to precisely transmit a driving force.

In accordance with an aspect of the present invention, there is provided a driving apparatus of an embroidery frame of a sewing machine including: at least one X-directional movement mechanism to move the embroidery frame to support an object to be embroidered in right-to-left direction (X-direction); and at least one Y-directional movement mechanism to move the embroidery frame to support an object to be embroidered in front-to-rear direction (Y-direction); any one of the X-directional movement mechanism and the Y-directional movement mechanism including: a fixed frame installed to a beam-body of the sewing machine and having gear teeth; and an embroidery frame driving unit installed on the fixed frame to reciprocate and engaged with the gear teeth to reciprocate the embroidery frame.

Moreover, a driving apparatus of an embroidery frame of a sewing machine including: an embroidery frame driving unit having the embroidery frame to fix and hold an object to be embroidered and placed on a table of the sewing machine; and at least one Y-directional movement mechanism to move the frame driving unit in the front-to-rear direction; the Y-directional movement mechanism including: a fixed frame installed in the upper side of the frame driving unit in the Y-direction and having gear teeth; and an embroidery frame driving unit installed on the fixed frame to reciprocate and engaged with the gear teeth to reciprocate the frame driving unit in the Y-direction.

The driving apparatus further includes an X-directional movement mechanism installed in the frame driving unit to reciprocate the embroidery frame in the X-direction, wherein the X-directional movement mechanism includes: a movable frame installed on the frame driving unit to reciprocate in the X-direction (right-to-left direction) and having gear teeth; and an embroidery frame driving unit engaged with the gear teeth of the movable frame to reciprocate the movable frame in the X-direction.

The movable frame includes a connecting body to freely detach the embroidery frame.

The embroidery frame driving unit includes: an engaging member engaged with the gear teeth formed in the fixed frame; a plurality of rotation members to rotatably support the engaging member; and a driving body to provide a rotational force to the engaging member.

The engaging member includes a belt-type member. The belt-type member includes gear teeth engaged with the gear teeth formed in the fixed frame.

The driving body includes gear teeth engaged with the engaging member.

The embroidery frame driving unit includes: an engaging member engaged with the gear teeth formed in the upper side of the fixed frame; and a driving body to provide a rotational force to the engaging member.

The engaging member includes a pinion.

Power sources are individually installed in the embroidery frame driving units.

The embroidery frame driving unit is driven by a single power source.

The beam-body includes a table.

Thus, the embroidery frame driving unit is installed in the beam-body of the sewing machine to reciprocate on the X-axis fixed frame and/or the Y-axis fixed frame so that a uniform movement driving force can be transmitted to overall embroidery frame, the deterioration of the quality of the embroidery product due to the vibration of the embroidery frame during the movement can be prevented, and the size of the table of the sewing machine can be reduced.

DRAWINGS

The above and other objects, features and advantages of the present invention will be more apparent from the following detailed description taken in conjunction with the accompanying drawings, in which.

DETAILED DESCRIPTION

Hereinafter, an exemplary embodiment of the present invention will be described with reference to the accompanying drawings.

EMBODIMENT

Figure 1:
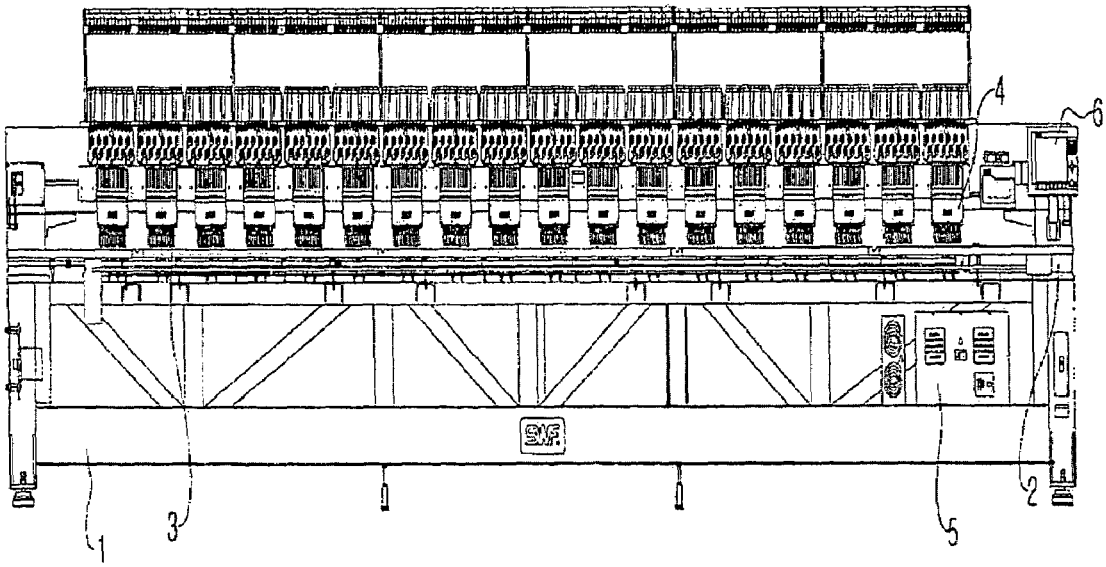
FIGURE 1 PRIOR ART
FIG. 1 is a view illustrating an overall external appearance of a conventional multi-head type automatic embroidery machine.
Figure 2:
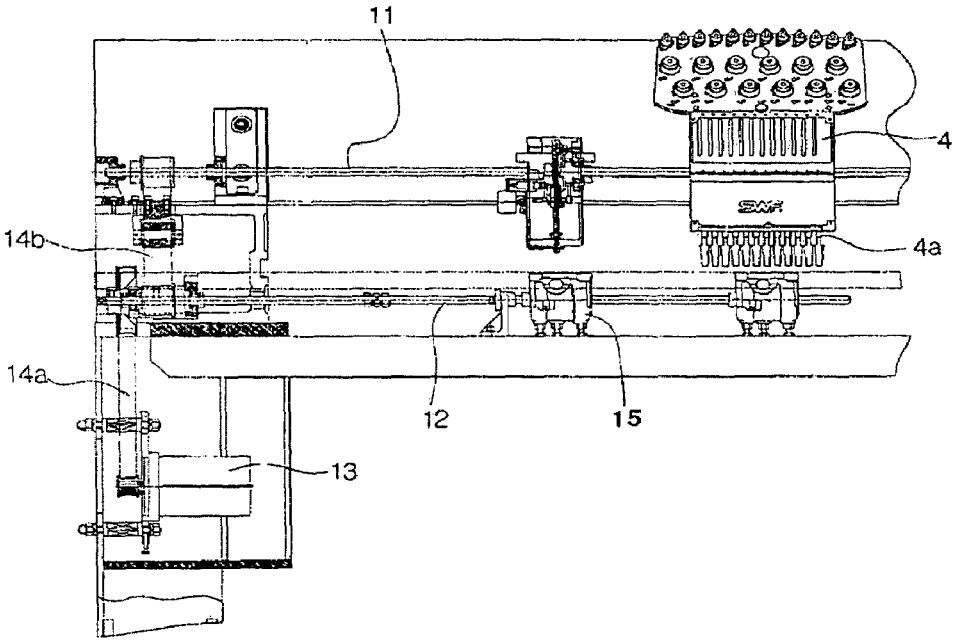
FIGURE 2 PRIOR ART
FIG. 2 is a view illustrating a head and a shuttle driving unit of the automatic embroidery machine in FIG. 1.
Figure 3:
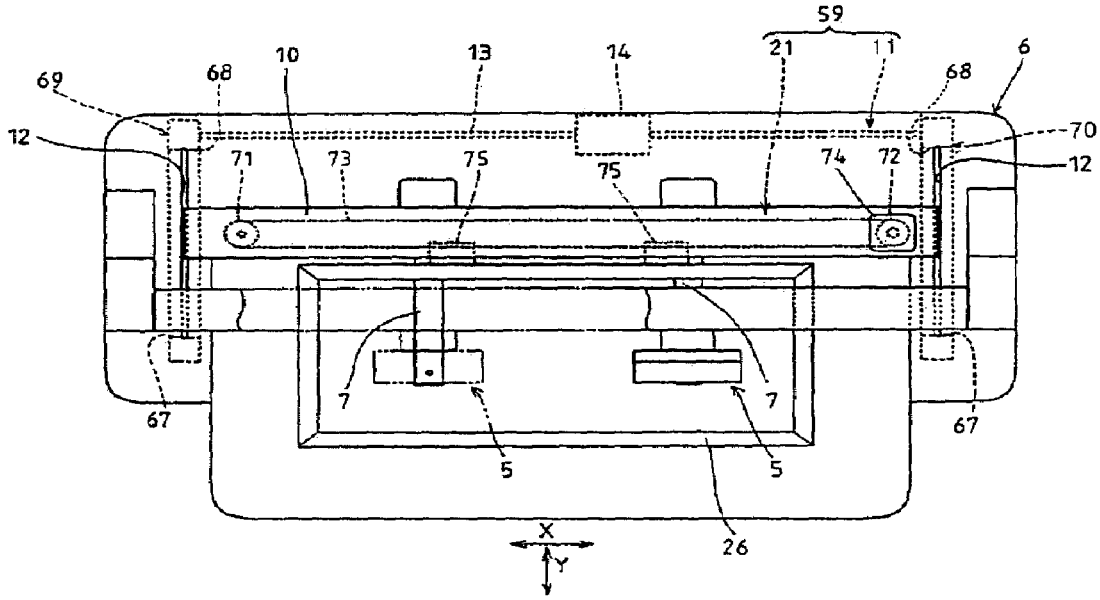
FIGURE 3 PRIOR ART
FIG. 3 is a plan view illustrating a conventional driving apparatus of an embroidery frame of a sewing machine.
Figure 4:
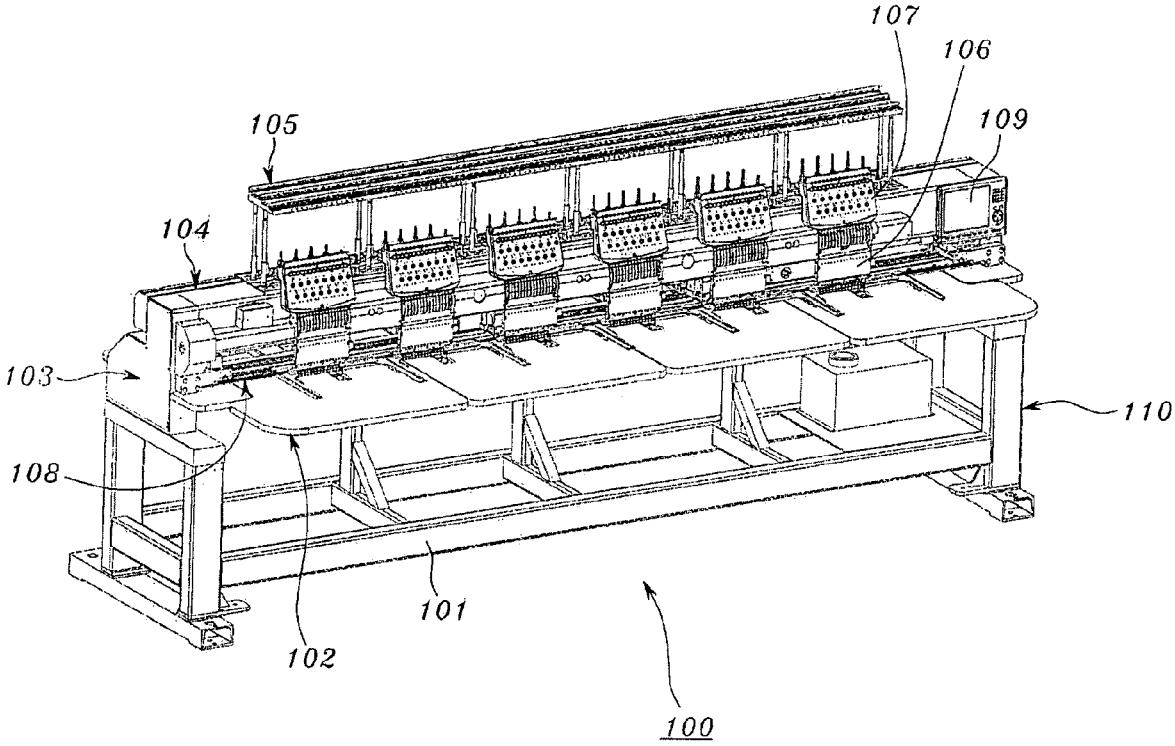
FIGS. 4 and 5 are front and rear perspective views illustrating a sewing machine having a driving apparatus of an embroidery frame of a sewing machine according to an embodiment of the present invention.
Figure 5:
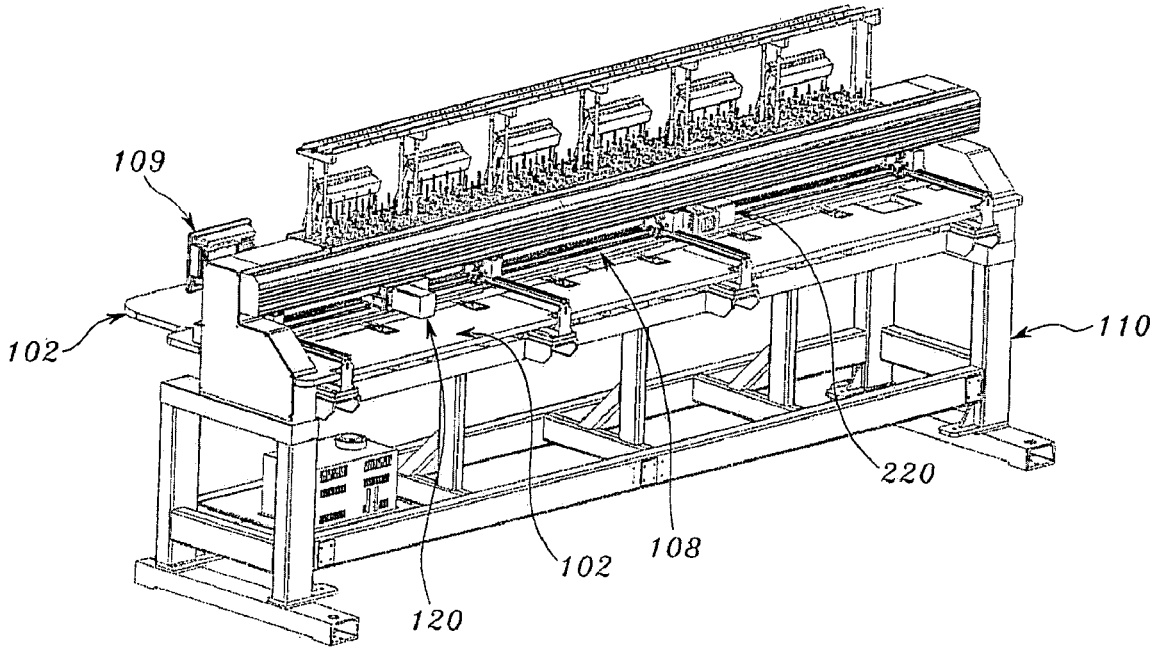
Figure 6:
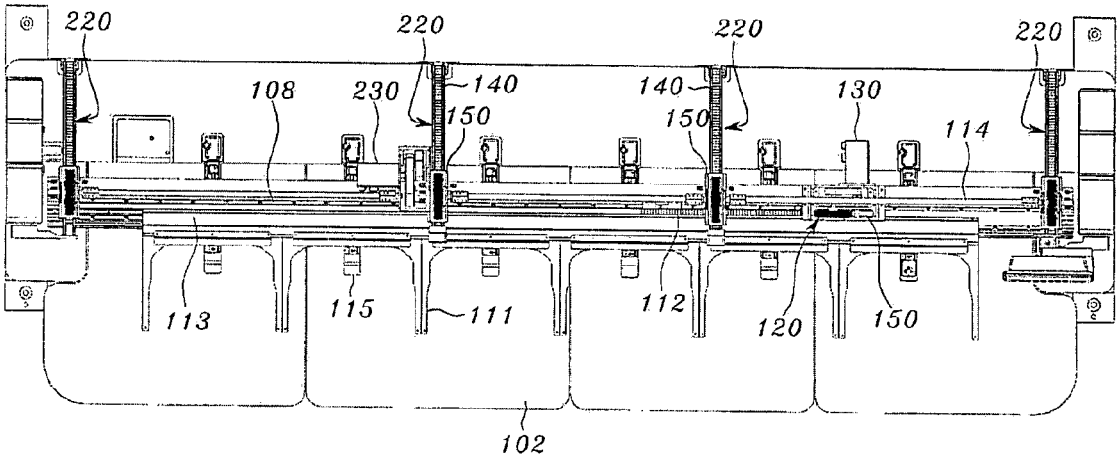
FIGS. 6 and 7 are a plan view and a perspective view illustrating the driving apparatus of an embroidery frame of a sewing machine according to the embodiment of the present invention.
Figure 7:
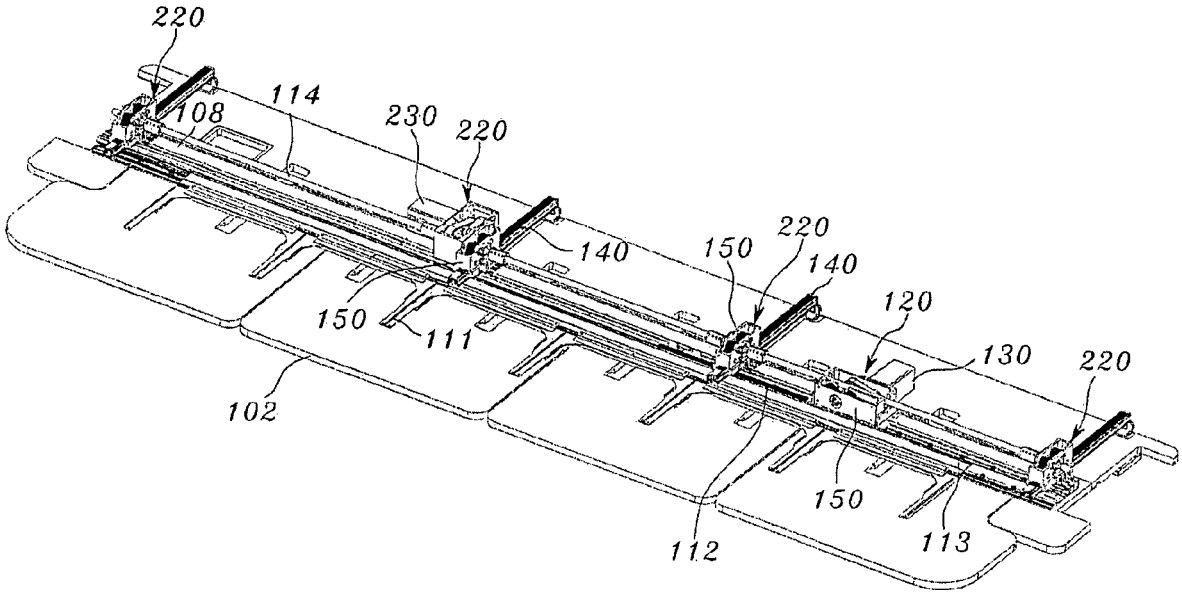
Figure 8:
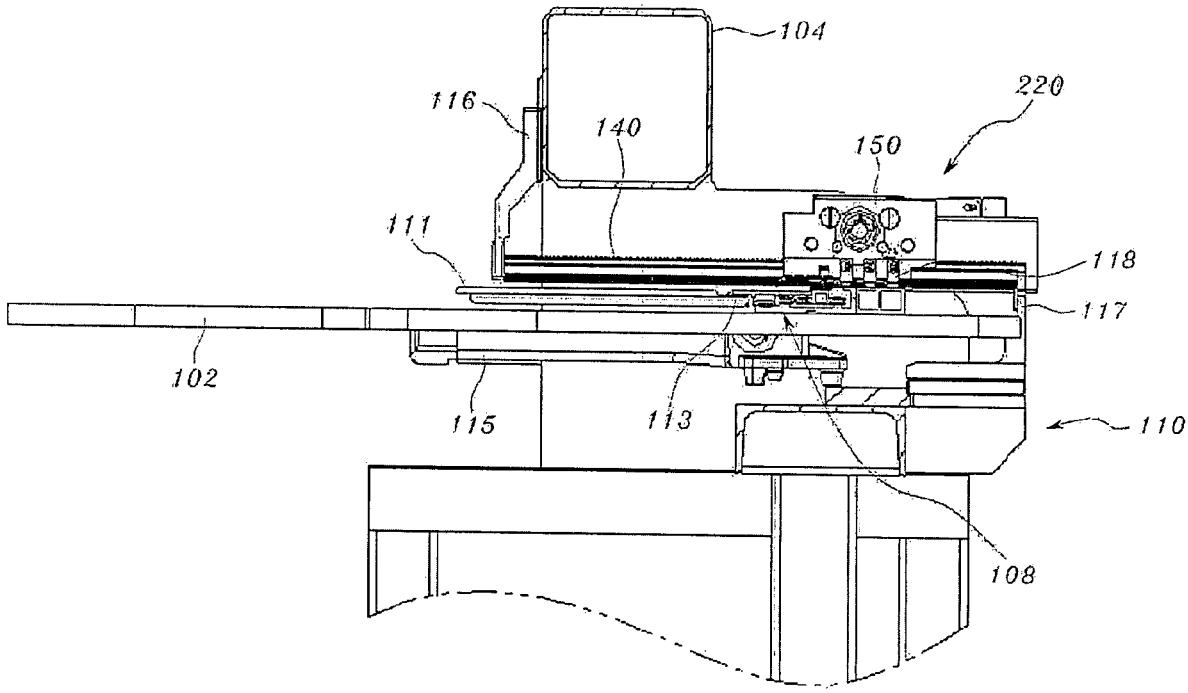
FIG. 8 is a side view illustrating the driving apparatus of an embroidery frame of a sewing machine according to the present invention.
Figure 9:
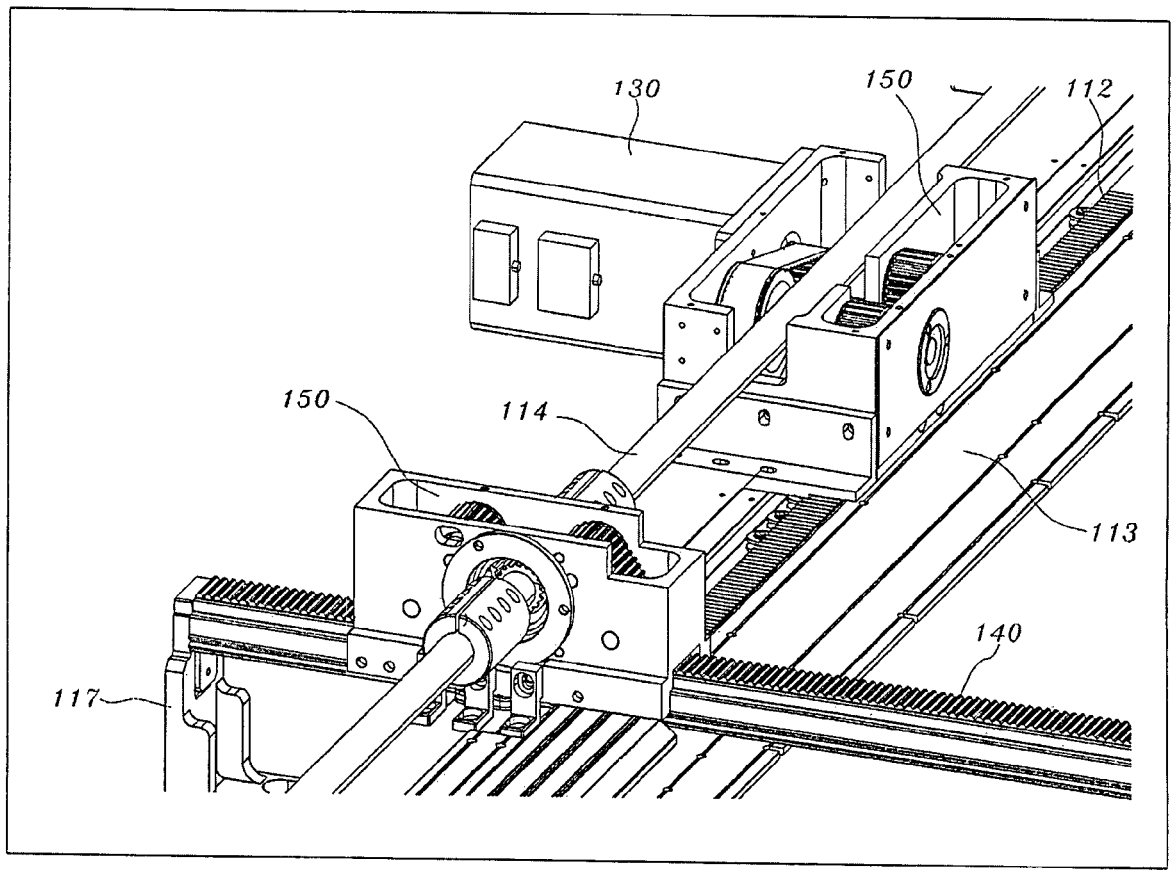
FIGS. 9 and 10 are detailed views illustrating an embroidery frame driving unit of a sewing machine according to the embodiment of the present invention.
Figure 10:
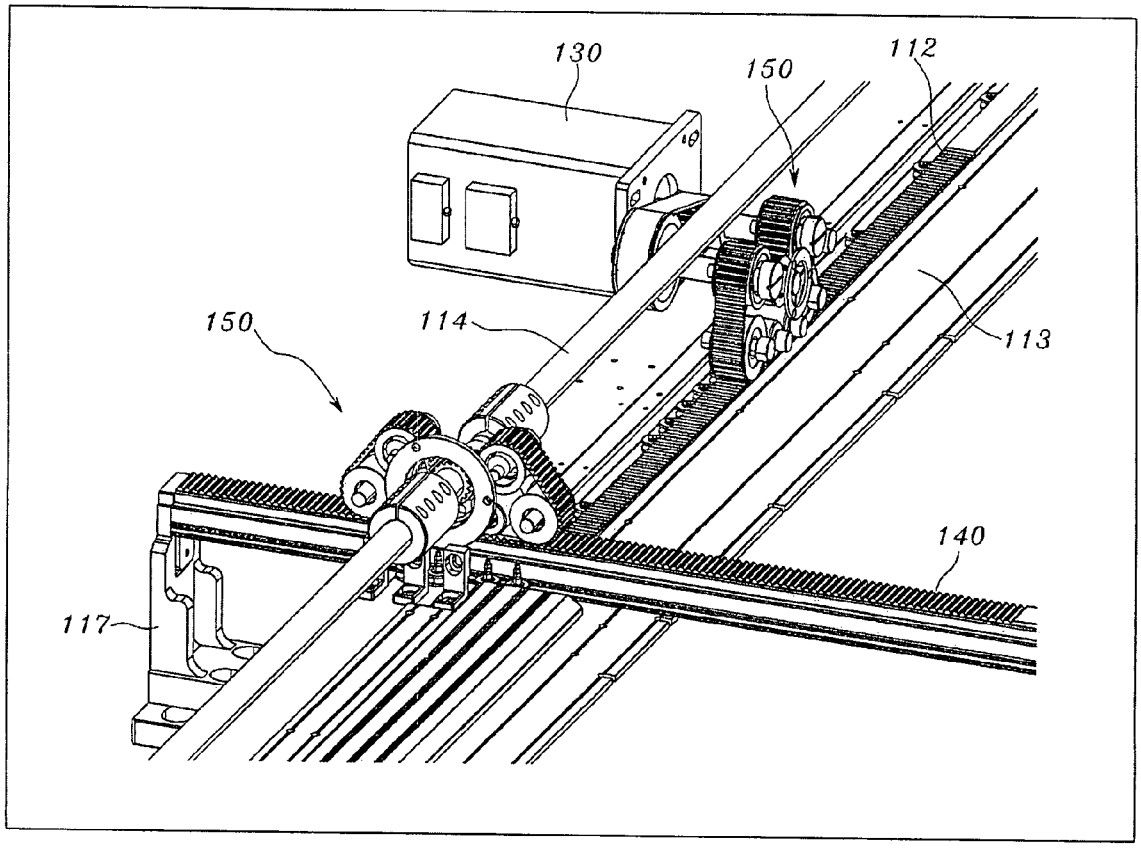
Figure 11:
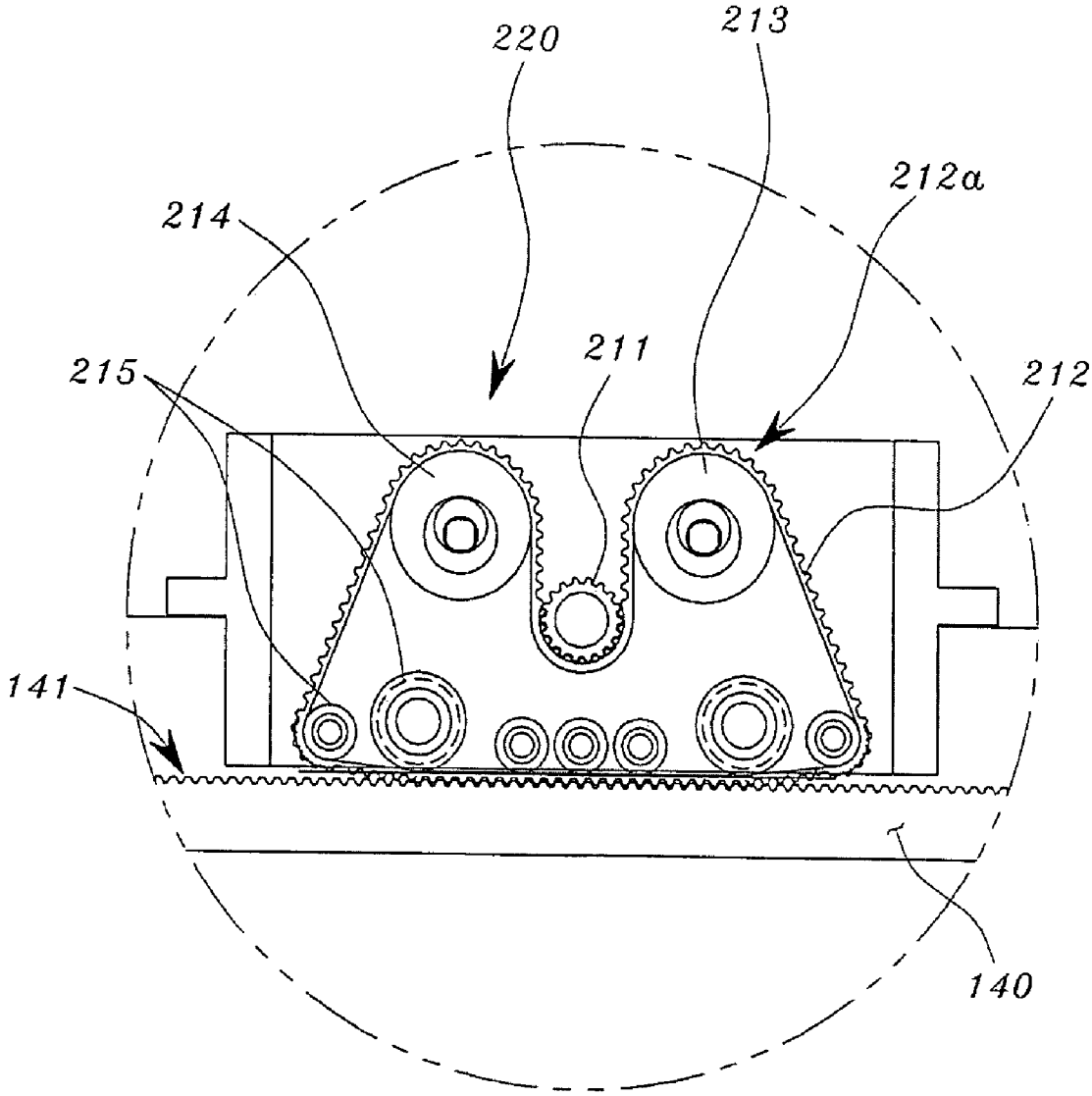
FIG. 11 is a view illustrating an example of a movement mechanism employed in the present invention such as a Y-directional movement mechanism.

FIGS. 4 and 5 are front and rear perspective views illustrating a sewing machine having a driving apparatus of an embroidery frame of a sewing machine according to an embodiment of the present invention, FIGS. 6 and 7 are a plan view and a perspective view illustrating the driving apparatus of an embroidery frame of a sewing machine according to the embodiment of the present invention, FIG. 8 is a side view illustrating the driving apparatus of an embroidery frame of a sewing machine according to the present invention, FIGS. 9 and 10 are detailed views illustrating an embroidery frame driving unit of a sewing machine according to the embodiment of the present invention, and FIG. 11 is a view illustrating an example of a movement mechanism employed in the present invention such as a Y-directional movement mechanism.

The driving apparatus of an embroidery frame according to the embodiment of the present invention, as illustrated, includes at least one X-directional movement mechanism 120 to move an embroidery frame 111 to support an object to be embroidered in the right-to-left direction (X-direction), and at least one Y-direction movement mechanism 220 to move the embroidery frame 111 in the front-to-rear direction (Y-direction). Here, one of the X-directional movement mechanism 120 and the Y-directional movement mechanism 220 includes a fixed frame 140 installed to a beam-body of the sewing machine and having gear teeth, and embroidery frame driving units 150 installed on the fixed frame 140 to reciprocate and engaged with the gear teeth to reciprocate the embroidery frame 111.

In more detail, the driving apparatus of an embroidery frame of a sewing machine 100 includes a frame driving unit 108 having the embroidery frame 111 to fix and hold the object to be embroidered and placed on a table 102 of the sewing machine 100, and at least one Y-directional movement mechanism 220 to move the frame driving unit 108 in the forward and backward direction of the sewing machine 100. The Y-directional movement mechanism 220 includes a fixed frame 140 installed in the upper side of the frame driving unit 108 in the Y-direction and having gear teeth, and an embroidery frame driving unit 150 installed on the fixed frame 140 to reciprocate and engaged with the gear teeth to reciprocate the frame driving unit 108 forward and backward in the Y-direction.

Moreover, the driving apparatus of an embroidery frame of a sewing machine further includes an X-directional movement mechanism 120 installed in the frame driving unit 108 to reciprocate the embroidery frame 11 in the X-direction. In this case, the X-directional movement mechanism 120 includes a movable frame 112 installed on the frame driving unit 108 in the X-direction (right-to-left direction) and having gear teeth, and an embroidery frame driving unit 150 engaged with the gear teeth of the movable frame 112 to reciprocate the movable frame 112 in the X-direction.

On the other hand, the embroidery frame driving unit 150, as illustrated in FIG. 11, includes an engaging member 212 engaged with the gear teeth formed in the fixed frame 140, a plurality of rotation members 213 to 215 to rotatably support the engaging member 212, and a driving body 211 to provide a rotational force to the engaging member 212.

In this case, the engaging member 212 is implemented by a belt-type member having gear teeth 212*a* engaged with the gear teeth 141 formed in the fixed frame 140.

Moreover, the plurality of rotation members 213 to 215 supports the engaging member 212, the driving body 211 is positioned between rotation members among the plural rotation members 213 to 215 installed at the positions higher than rotation shafts of the rotation members positioned at the lower side and at the lower side, and the engaging member 212 has a reversed U-shape formed by the driving body 211 installed between the two rotation members.

Moreover, the plurality of rotation members 213 to 215 is implemented by idlers.

In the embodiment of the present invention, although the embroidery frame driving unit 150 of the Y-directional movement mechanism 220 has been described, the embroidery frame driving unit 150 of the X-directional movement mechanism 120 can be implemented as the configuration of the embroidery frame driving unit 150 of the Y-directional movement mechanism 220.

The embroidery frame 111 to fix and hold the object to be embroidered can be freely attached to and detached from the movable frame 112 by the connecting body 113.

A Y-axis driving motor 230 to driving the embroidery frame driving unit 150 is preferably provided in the embroidery frame driving unit 150 of the Y-directional movement mechanism 220 positioned at the center, among a plurality of Y-directional movement mechanisms 220 so as to provide a uniform driving force.

In at least one embroidery frame driving unit 150 configured as described above, a pulley (not shown), mounted to a connecting shaft 114 elongated in the X-direction to drive driving bodies 211 of the respective embroidery frame driving units, is connected to a driving shaft (not shown) of the Y-axis driving motor 230 by a timing belt (not shown) to drive and move the respective embroidery frame driving units.

In some of the fixed frames 140 of the Y-directional movement mechanism 220, in order to prevent vibration and shaking, one sides (front ends) thereof are fixed to upper frames 104 by first brackets 116 and the opposite sides (rear ends) thereof are fixed to a lower frame 110 by second brackets 117 (See FIG. 8). Moreover, the Y-directional movement mechanism 220 is fixed as such a front end is fixed to a supporting shaft to support the upper frame 104 and a rear end is fixed to a rear side of the lower frame 110.

In the lower side of the embroidery frame driving unit 150, as illustrated in FIG. 8, a fixing member 118 to fix the frame driving unit 108 is provided such that the fixing member 118 reciprocates together the embroidery frame driving unit 150 with respect to the fixed frame 140 to move the frame driving unit 108 in the front-to-rear direction (Y-direction) of the sewing machine.

In another embodiment of the present invention, the fixed frame 140 of the Y-directional movement mechanism 220 may be installed in the lower side of the table 102, and the embroidery frame driving unit 150 may reciprocate on the table 102 in the front-to-rear direction (Y-direction) due to a slit formed in the table 102 in the Y-direction.

Moreover, although the X-directional movement mechanism 120 is installed in the frame driving unit 108 such that the embroidery frame driving unit 150 moves the movable frame 112 in the right-to-left direction (X-direction) to move the embroidery frame 111, it is possible that the fixed frame 140 is installed in the frame driving unit 108 and the embroidery frame driving unit 150 reciprocates thereon to move the embroidery frame 11 in the right-to-left direction (X-direction).

On the other hand, power sources to provide the driving force to the movement mechanisms of the embroidery frame described in the embodiments of the present invention may be individually installed to the embroidery frame driving units, or a power source may use a single common driving motor such that a single output shaft is connected to plural driving boxes to drive the movable frame.

Here, the engaging member installed in the embroidery frame driving unit may be a belt type power transmitting member such as a timing belt, a chain, or a driven gear directly engaged with the driving body.

Moreover, the driving body installed in the embroidery frame driving unit and connected to the power source includes all of devices and units to transmit the driving force of the power source such as a timing pulley, a sprocket, a driving gear, a driving pulley, and the like.

Furthermore, the above-described driving apparatus of an embroidery frame of a sewing machine can be applied to every sewing machine to which the Y-directional movement mechanism or the X-directional movement mechanism is applied.

On the other hand, as another example, the embroidery frame driving unit 150 may include an engaging member engaged with the gear teeth formed in the upper side of the fixed frame, and a driving body to provide the rotational force to the engaging member. In this case, preferably, a pinion may be used as the engaging member.

As described above, according to the driving apparatus of an embroidery frame of a sewing machine of the present invention, the embroidery frame driving unit is installed in the beam-body of the sewing machine to reciprocate on the X-axis fixed frame and/or the Y-axis fixed frame so that a uniform movement driving force can be transmitted to overall embroidery frame, the embroidery is precisely performed according to embroidery data at a high-speed to obtain a high-quality embroidery product, and the Y-direction width of the sewing machine is reduced to decrease the overall width of the sewing machine.

Moreover, the movement mechanisms to drive the embroidery frame are installed in the upper side of the table of the sewing machine to transmit a uniform movement driving force to the embroidery frame driving unit, and the deflection and deformation of the embroidery frame driving unit are prevented to precisely drive the embroidery frame at a high-speed to obtain high-quality embroidery patterns.

Furthermore, the embroidery frame driving unit of a sewing machine, having a rack and pinion type power transmission to precisely transmit a driving force using a timing belt with gear teeth, engaged with the gear teeth of the fixed frame having the gear teeth and installed in the beam-body of the sewing machine, is provided, so that a uniform movement driving force can be transmitted to the overall embroidery frame, the embroidery is precisely performed according to the embroidery data at a high-speed to obtain high-quality embroidery patterns, and the Y-directional width of the sewing machine is reduced to decrease the overall width of the sewing machine.

Furthermore, the precision, the high-speed operation, and the durability of the embroidery frame can be achieved, as well, it is possible to minimize the increase of the number of components, costs, and driving noise, to prevent the deflection of the embroidery frame, and to achieve the precise operation of the embroidery frame even when driving a large sized embroidery frame.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A driving apparatus of an embroidery frame of a sewing machine, comprising:

at least one X-directional movement mechanism to move the embroidery frame to support an object to be embroidered in right-to-left direction (X-direction); and at least one Y-directional movement mechanism to move the embroidery frame to support an object to be embroidered in front-to-rear direction (Y-direction);

any one of the X-directional movement mechanism and the Y-directional movement mechanism comprising:

a fixed frame installed to a beam-body of the sewing machine and having gear teeth; and an embroidery frame driving unit installed on the fixed frame to reciprocate and engaged with the gear teeth to reciprocate the embroidery frame, said embroidery frame driving unit including:

an engaging member engaged with the gear teeth formed in the fixed frame;

a plurality of rotation members to rotatably support the engaging member; and a driving body to provide a rotational force to the engaging member.

2. A driving apparatus of an embroidery frame of a sewing machine, comprising:

an embroidery frame driving unit having the embroidery frame to fix and hold an object to be embroidered and placed on a table of the sewing machine; and at least one Y-directional movement mechanism to move the frame driving unit in the front-to-rear direction, wherein the Y-directional movement mechanism comprises:

a fixed frame installed in the upper side of the frame driving unit in the Y-direction and having gear teeth; and an embroidery frame driving unit installed on the fixed frame to reciprocate and engaged with the gear teeth to reciprocate the frame driving unit in the Y-direction, said embroidery frame driving unit including:

an engaging member engaged with the gear teeth formed in the fixed frame;

a plurality of rotation members to rotatably support the engaging member; and a driving body to provide a rotational force to the engaging.

3. The driving apparatus of an embroidery frame of a sewing machine as claimed in claim 2, further comprising an X-directional movement mechanism installed in the frame driving unit to reciprocate the embroidery frame in the X-direction, wherein the X-directional movement mechanism comprises:

a movable frame installed on the frame driving unit to reciprocate in the X-direction (right-to-left direction) and having gear teeth; and an embroidery frame driving unit engaged with the gear teeth of the movable frame to reciprocate the movable frame in the X-direction.

4. The driving apparatus of an embroidery frame of a sewing machine as claimed in claim 3, wherein the movable frame comprises a connecting body to freely detach the embroidery frame.

5. The driving apparatus of an embroidery frame of a sewing machine as claimed in claim 1, wherein the engaging member comprises a belt-type member.

6. The driving apparatus of an embroidery frame of a sewing machine as claimed in claim 5, wherein the belt-type member comprises gear teeth engaged with the gear teeth formed in the fixed frame.

7. The driving apparatus of an embroidery frame of a sewing machine as claimed in claim 1, wherein the driving body comprises gear teeth engaged with the engaging member.

8. The driving apparatus of an embroidery frame of a sewing machine as claimed in claims 1 or 2, wherein the embroidery frame driving unit comprises:

an engaging member engaged with the gear teeth formed in the upper side of the fixed frame; and a driving body to provide a rotational force to the engaging member.

9. The driving apparatus of an embroidery frame of a sewing machine as claimed in claim 8, wherein the engaging member comprises a pinion.

10. The driving apparatus of an embroidery frame of a sewing machine as claimed in claims 1 or 2, wherein power sources are individually installed in the embroidery frame driving units.

11. The driving apparatus of an embroidery frame of a sewing machine as claimed in claims 1 or 2, wherein the embroidery frame driving unit is driven by a single power source.

12. The driving apparatus of an embroidery frame of a sewing machine as claimed in claims 1 or 2, wherein the beam-body comprises a table.

* * * * *